US010746085B2

(12) United States Patent
Cho et al.

(10) Patent No.: US 10,746,085 B2
(45) Date of Patent: Aug. 18, 2020

(54) METHOD AND APPARATUS FOR CONTROLLING WATER PUMP FOR VEHICLE

(71) Applicants: HYUNDAI MOTOR COMPANY, Seoul (KR); KIA MOTORS CORPORATION, Seoul (KR)

(72) Inventors: In-Eok Cho, Incheon (KR); Hoon Han, Hwaseong-si (KR); Jae-Yun Shim, Hwaseong-si (KR); Il-Kwon Park, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/540,719

(22) Filed: Aug. 14, 2019

(65) Prior Publication Data

US 2019/0368408 A1 Dec. 5, 2019

Related U.S. Application Data

(62) Division of application No. 14/941,274, filed on Nov. 13, 2015, now Pat. No. 10,428,723.

(30) Foreign Application Priority Data

Jun. 18, 2015 (KR) ..... 10-2015-0086695

(51) Int. Cl.
*F01P 7/16* (2006.01)
*F01P 5/10* (2006.01)
*F01P 5/12* (2006.01)

(52) U.S. Cl.
CPC ..... *F01P 7/164* (2013.01); *F01P 7/16* (2013.01); *F01P 2005/105* (2013.01);
(Continued)

(58) Field of Classification Search
CPC ..... F01P 7/164; F01P 7/00; F01P 5/10; F01P 2005/105; F01P 2037/00; F01P 2025/64; F01P 2025/08
See application file for complete search history.

(56) References Cited

U.S. PATENT DOCUMENTS 5,724,924 A 3/1998 Michels
6,352,055 B1 * 3/2002 Algrain ..... F01P 7/164 123/41.44

(Continued)

FOREIGN PATENT DOCUMENTS

JP 2009-228429 A 10/2009
JP 2010-007571 A 1/2010

(Continued)

OTHER PUBLICATIONS

Notice of Allowance issued in related U.S. Appl. No. 14/941,274 dated May 22, 2019.

(Continued)

*Primary Examiner* — Grant Moubry
(74) *Attorney, Agent, or Firm* — Morgan, Lewis & Bockius LLP

(57) ABSTRACT

A method for controlling a water pump for a vehicle includes: determining whether an engine is on; measuring a coolant temperature of the engine and an RPM of the engine when the engine is determined to be operated; determining whether the measured coolant temperature is equal to or greater than a predetermined coolant temperature; determining an RPM of a water pump, which adjusts a coolant flow rate, from the measured coolant temperature and the measured RPM of the engine, when the measured coolant temperature is determined to be equal to or greater than the predetermined coolant temperature; and controlling the
(Continued)

water pump such that the water pump is operated according to the determined RPM of the water pump.

1 Claim, 16 Drawing Sheets

(52) U.S. Cl.
CPC ..... *F01P 2005/125* (2013.01); *F01P 2025/08* (2013.01); *F01P 2025/32* (2013.01); *F01P 2025/62* (2013.01); *F01P 2025/64* (2013.01); *F01P 2037/00* (2013.01); *F01P 2037/02* (2013.01); *F01P 2060/04* (2013.01); *F01P 2060/08* (2013.01); *F01P 2060/16* (2013.01)

(56) References Cited

U.S. PATENT DOCUMENTS

| | | | | |
|---|---|---|---|---|
| 7,735,744 | B2 | 6/2010 | Eisenhour | |
| 8,069,827 | B2 | 12/2011 | Watanabe et al. | |
| 9,169,751 | B2 * | 10/2015 | Hussain | F01N 3/0205 |
| 9,188,053 | B2 * | 11/2015 | Abihana | F01P 7/164 |
| 9,562,444 | B2 * | 2/2017 | Nagai | F01P 7/165 |
| 9,695,827 | B2 | 7/2017 | Araki et al. | |
| 2015/0121847 | A1 * | 5/2015 | Pursifull | F01N 5/02 60/274 |
| 2016/0341100 | A1 * | 11/2016 | Nagai | F01N 5/02 |

FOREIGN PATENT DOCUMENTS

| | | | |
|---|---|---|---|
| JP | 2010-031701 | A | 2/2010 |
| JP | 2010-053772 | A | 3/2010 |
| JP | 2013-142432 | A | 7/2013 |
| KR | 10-2012-0108921 | A | 10/2012 |
| KR | 10-2013-0031539 | A | 3/2013 |

OTHER PUBLICATIONS

Non-Final Office Action issued in related U.S. Appl. No. 14/941,274 dated Feb. 4, 2019.

* cited by examiner

METHOD AND APPARATUS FOR CONTROLLING WATER PUMP FOR VEHICLE

CROSS-REFERENCE TO RELATED APPLICATIONS

This application is the Divisional application of U.S. patent application Ser. No. 14/941,274, filed on Nov. 13, 2015, now allowed, which claims the benefit of priority to Korean Patent Application No. 10-2015-0086695, filed on Jun. 18, 2015, which is incorporated herein by reference in its entirety.

TECHNICAL FIELD

The present disclosure relates to a method and an apparatus for controlling a water pump for a vehicle, and more particularly, to a method and an apparatus for controlling a water pump for a vehicle, capable of controlling a coolant flow rate to maximize efficiency of an exhaust heat recovery system.

BACKGROUND

Engine coolant passes through an engine and then flows in a direction in which a radiator, an oil cooler, and an exhaust gas recirculation (EGR) cooler flow parallel with each other. Particularly, a water pump is provided at two types of cooling passages in order to form the flow of engine coolant in a hybrid vehicle to which a conventional exhaust heat recovery system is mounted, as illustrated in FIGS. 1 and 2.

In a cooling passage illustrated in FIG. 1 (hereinafter, referred to as a "first type of cooling passage), an electronic water pump 12 is used and a coolant flow is formed such that a revolutions per minute (RPM) of the water pump is electrically controlled. In a cooling passage illustrated in FIG. 2 (hereinafter, referred to as a "second type of cooling passage), a first water pump 120 for supplying coolant to an engine 100 and an auxiliary second water pump 400 for heating are provided. The first water pump 120 is a mechanical water pump and is operated only when the engine 100 is running. The second water pump 400 is operated to supply coolant to a heater 170 only when heating is required and the engine 100 is fully warmed up and is not driven. For reference, when the hybrid vehicle stops or travels at low speed or low torque, the engine 100 may be stopped for an improvement in fuel efficiency. However, when there is a need to secure a heat source for heating, the engine 100 is driven under all conditions until the engine 100 is fully warmed up.

In addition, the exhaust heat recovery system illustrated in FIGS. 1 and 2 is a system for rapidly warming up the engine by heating coolant using the heat of exhaust gas discarded when the engine is driven. Thus, the fuel efficiency of the vehicle may be improved through a reduction in friction of the engine. A heat exchange amount in the exhaust heat recovery system is increased by the following methods: a method of increasing the amount or temperature of exhaust gas and a method of increasing the flow rate of coolant with which heat is exchanged in the exhaust heat recovery system (see Table 1).

TABLE 1

| Test result at exhaust temperature of 300° C. | Coolant temperature reaching time (30° C. → 70° C.) |
|---|---|
| Coolant flow rate: 10 L | 14 minutes and 24 seconds |
| Coolant flow rate: 20 L | 12 minutes and 51 seconds |

However, in the method of increasing the amount or temperature of exhaust gas, it is difficult to control the amount or temperature of exhaust gas since the amount or temperature of exhaust gas are determined by the operation of the engine set according to a traveling state of the vehicle.

In the conventional first type of cooling passage, the RPM of the water pump is controlled such that an engine heat loss is minimized when the coolant temperature is low, and the RPM of the water pump is controlled such that the engine is not overheated when the coolant temperature is high. In the conventional second type of cooling passage, the first water pump is mechanically operated along with the RPM of the engine, and the second water pump supplies coolant to the heater only when the heating is required and the engine is fully warmed up and is not driven. That is, since the conventional exhaust heat recovery system exchanges heat between exhaust gas and only the coolant flow rate determined by the water pump of the engine which is basically operated for prevention of overheating of the engine when the engine is driven, the efficiency of the exhaust heat recovery system may not be maximized.

SUMMARY

The present disclosure is directed to a method and an apparatus for controlling a water pump for a vehicle, capable of controlling a coolant flow rate to maximize efficiency of an exhaust heat recovery system.

Other objects and advantages of the present disclosure can be understood by the following description and become apparent with reference to the embodiments of the present invention. It is obvious to those skilled in the art to which the present disclosure pertains that the objects and advantages of the present invention can be realized by the means as claimed and combinations thereof.

In accordance with an embodiment of the present inventive concept, a method for controlling a water pump for a vehicle includes: determining whether an engine is operated; measuring a coolant temperature of the engine and an revolutions per minute (RPM) of the engine when the engine is determined to be operated; determining whether the measured coolant temperature is equal to or greater than a reference coolant temperature; determining a first RPM of a water pump, which adjusts a coolant flow rate, from the measured coolant temperature and the measured RPM of the engine, when the measured coolant temperature is determined to be equal to or greater than the reference coolant temperature; and controlling the water pump such that the water pump is operated according to the determined RPM of the water pump.

The method may further include determining a second RPM of the water pump from an exhaust gas temperature, when the measured coolant temperature is determined to be less than the reference coolant temperature.

In the step of determining the first RPM, the first RPM of the water pump may be determined from the measured coolant temperature and the measured RPM of the engine according to a first table.

The step of determining the second RPM may include measuring the exhaust gas temperature.

The step of determining the second RPM may further include determining the RPM of the water pump from the measured exhaust gas temperature according to a second table.

The step of determining the second RPM may include measuring a torque of the engine.

The step of determining the second RPM may further include predicting the exhaust gas temperature from the measured RPM of the engine and the measured torque of the engine according to a third table.

The step of determining the second RPM may further include determining the RPM of the water pump from the predicted exhaust gas temperature according to a fourth table.

In accordance with another embodiment of the present inventive concept, an apparatus for controlling a water pump for a vehicle includes an engine, a water pump for supplying coolant to the engine, a radiator for cooling the coolant discharged from the engine, a thermostat arranged between the water pump and the radiator to open and close a coolant passage, an oil cooler for cooling oil using the coolant discharged from the engine, an exhaust gas recirculation (EGR) cooler for cooling recirculated exhaust gas using the coolant discharged from the engine, a heater for heating a vehicle interior using the coolant discharged from the EGR cooler, and an exhaust heat recovery system for increasing a temperature of the coolant discharged from the heater using the exhaust gas discharged from the engine. The apparatus includes a storage, a measurement unit including a first measurement unit for measuring an RPM of the engine, a torque of the engine, and a coolant temperature, and a second measurement unit for measuring an exhaust gas temperature, and a control unit determining an RPM of the water pump according to the measured RPM of the engine, the measured torque of the engine, the measured coolant temperature, and the measured exhaust gas temperature, so as to operate the water pump according to the determined RPM of the water pump.

In accordance with another embodiment of the present inventive concept, a method for controlling a water pump for a vehicle includes: determining whether a heater is operated; determining whether an engine is operated when the heater is off; measuring a coolant temperature when the engine is determined to be operated in the performing a first engine operation determination process; determining whether the measured coolant temperature is equal to or greater than a coolant temperature; and controlling an RPM of another water pump, which is used for heating and adjusts a coolant flow rate, from an exhaust gas temperature, when the measured coolant temperature is less than the coolant temperature.

The method may further include determining whether the engine is operated when the heater is on.

The method may further include operating the other water pump at a reference RPM when the engine is off.

The step of controlling the RPM of the other water pump may include measuring the exhaust gas temperature.

The step of controlling the RPM of the other water pump may further include determining the RPM of the other water pump from the measured exhaust gas temperature according to a fifth table.

The step of controlling the RPM of the other water pump may further include operating the other water pump according to the determined RPM of the other water pump (S530).

The step of controlling the RPM of the other water pump may include measuring an RPM of the engine and a torque of the engine.

The step of controlling the RPM of the other water pump may further include predicting the exhaust gas temperature from the measured RPM of the engine and the measured torque of the engine according to a sixth table.

The step of controlling the RPM of the other water pump may further include determining the RPM of the other water pump from the predicted exhaust gas temperature according to a seventh table.

The step of controlling the RPM of the other water pump may further include operating the other water pump according to the determined RPM of the other water pump.

DETAILED DESCRIPTION

Figure 1:
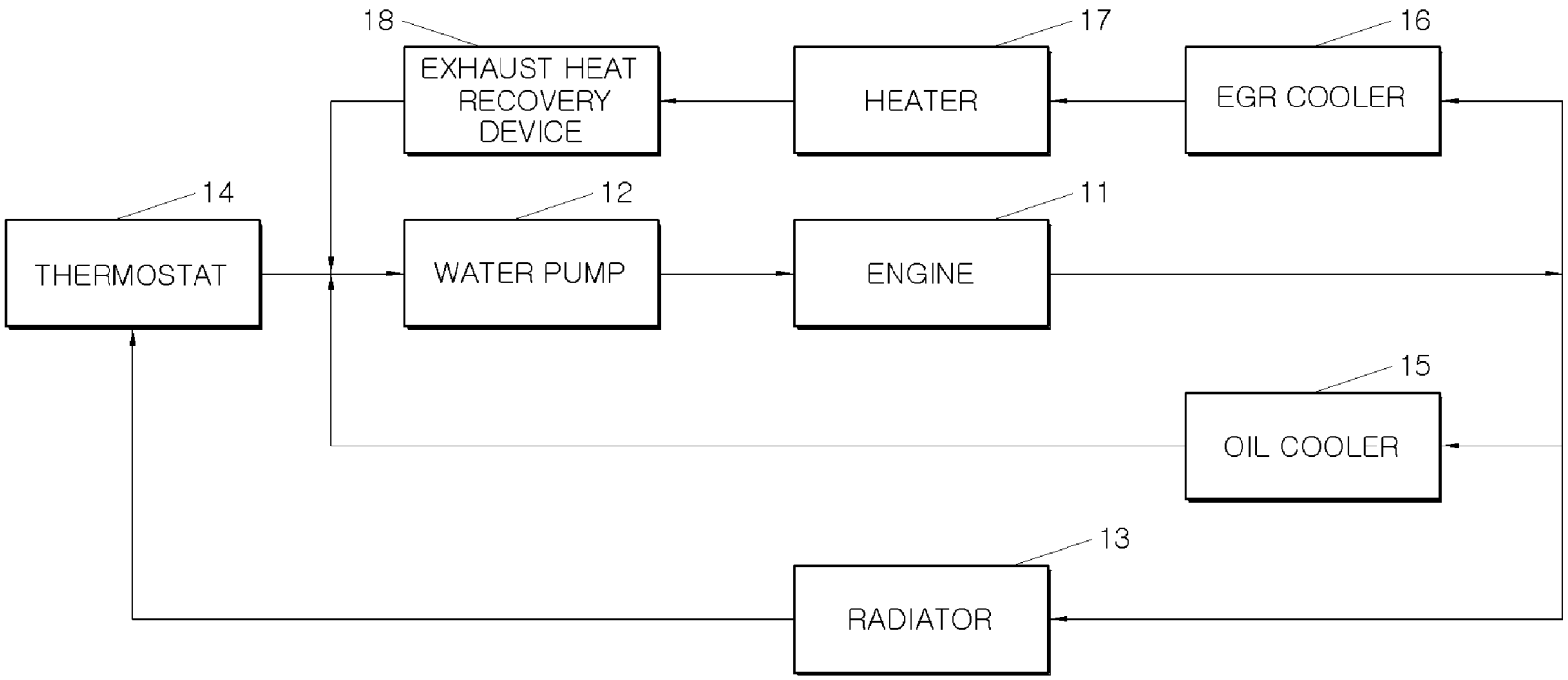
FIG.1 (Prior Art)
FIGS. 1 and 2 are block diagrams of cooling passages according to the related art.
Figure 2:
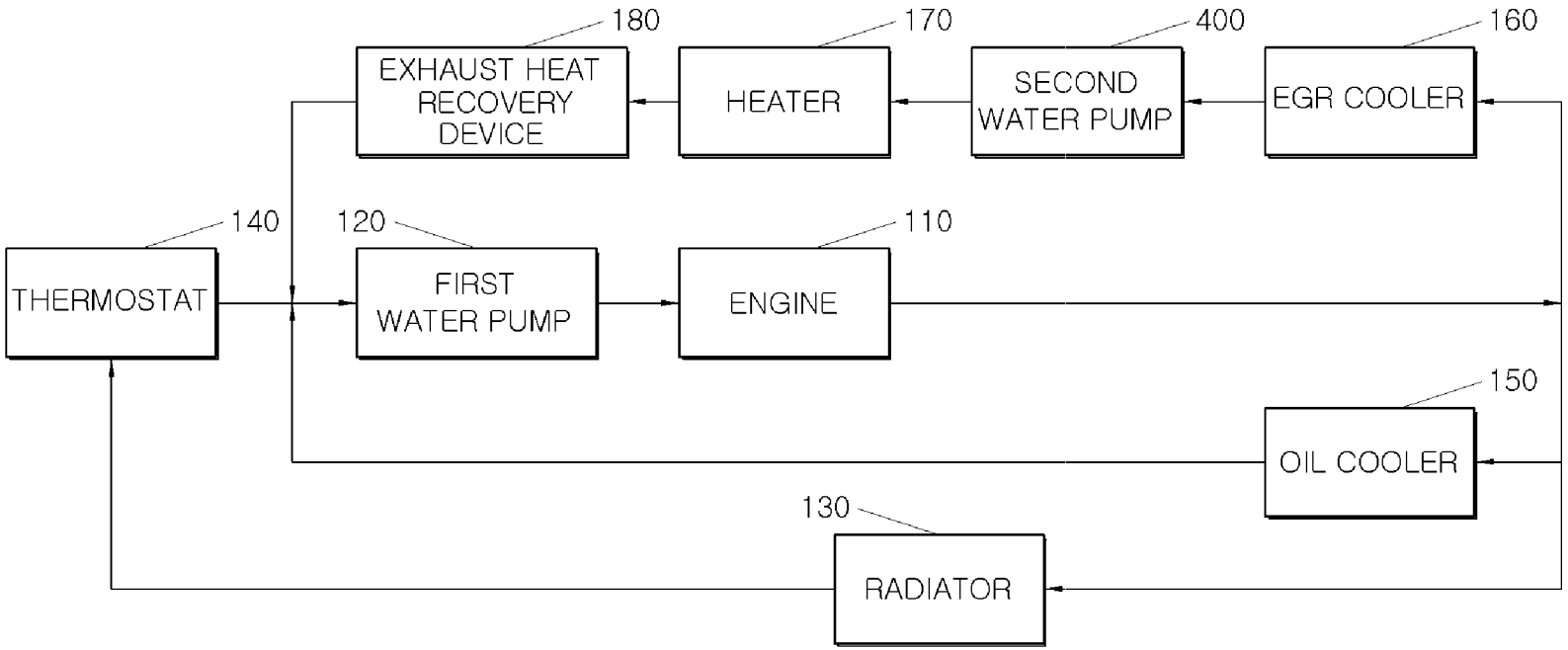
FIG.2(Prior Art)
Figure 3:
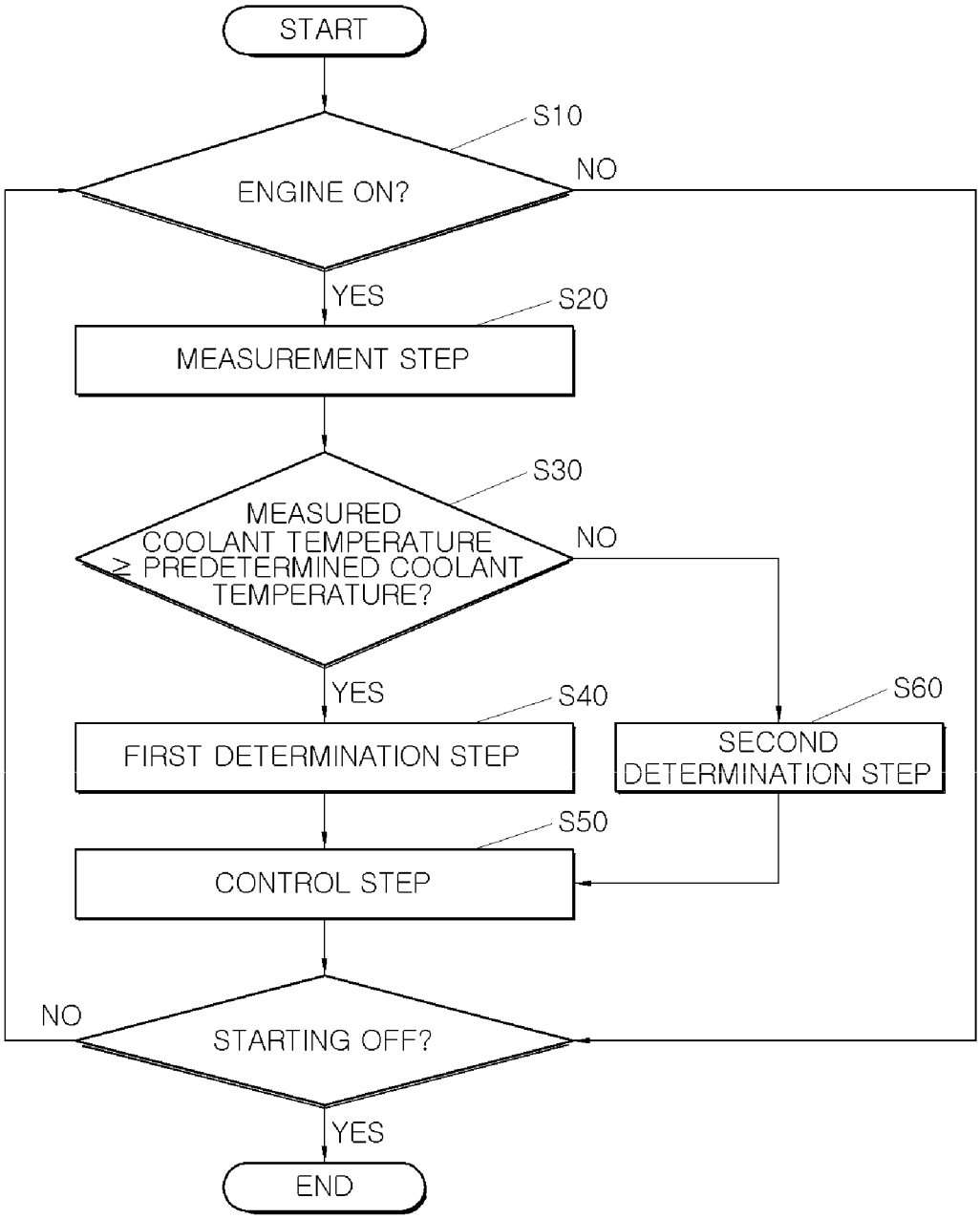
FIGS. 3 to 5B are flowcharts illustrating a method for controlling a water pump for a vehicle according to an embodiment of the present inventive concept.
Figure 4A:
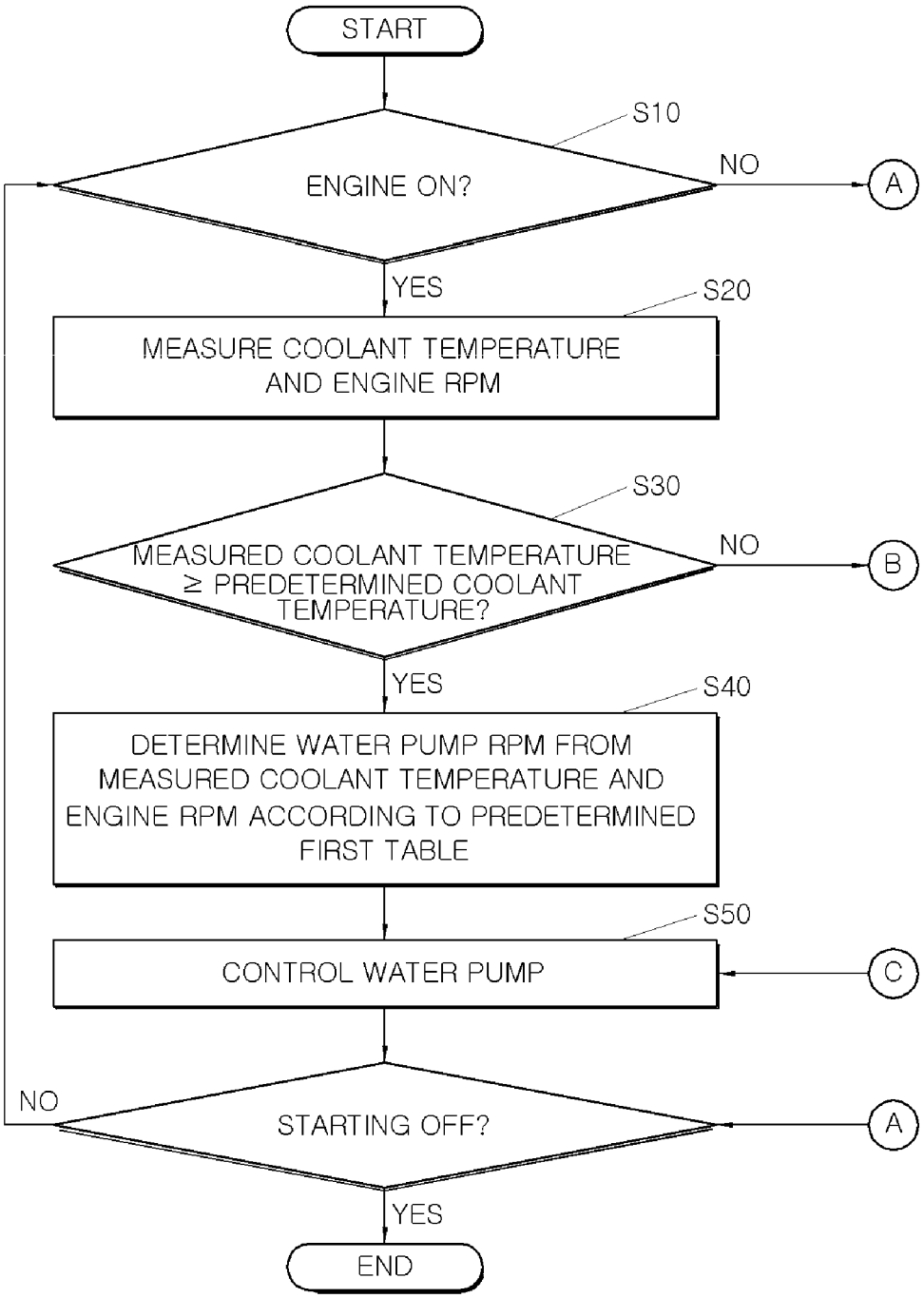
Figure 4B:
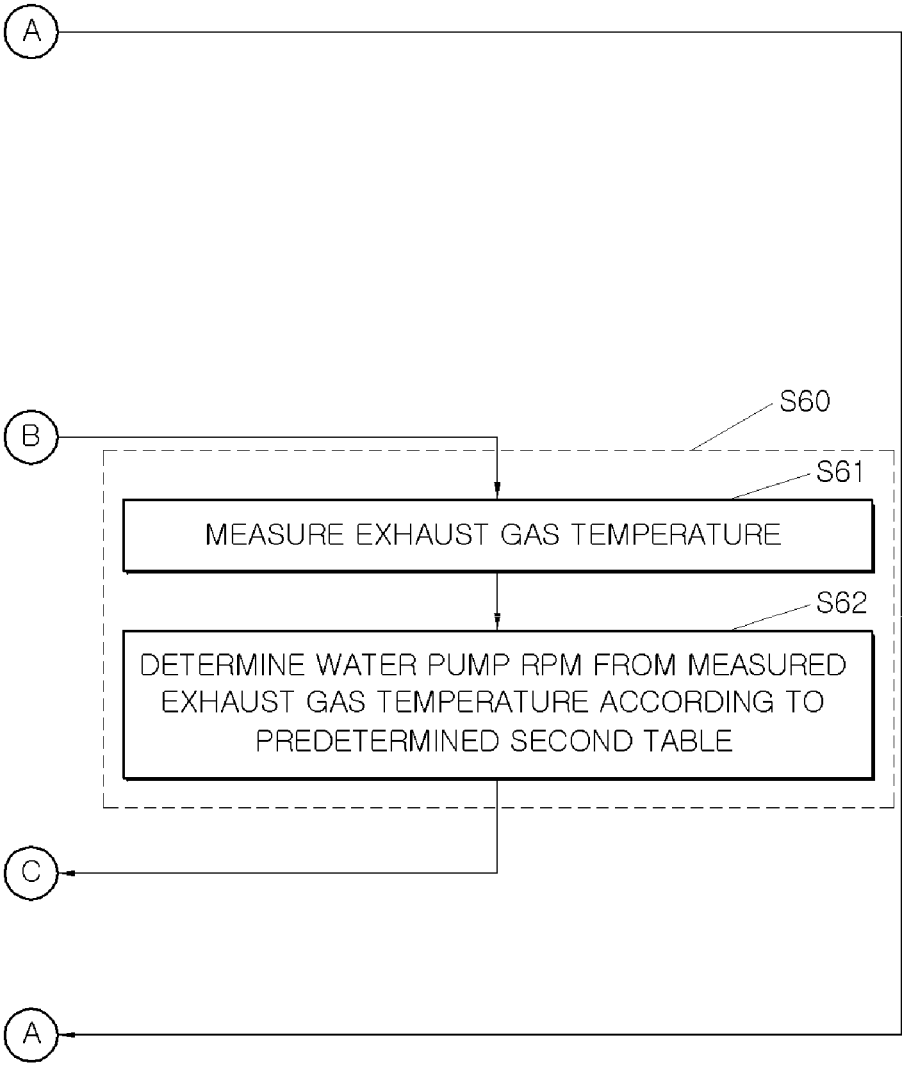
Figure 5A:
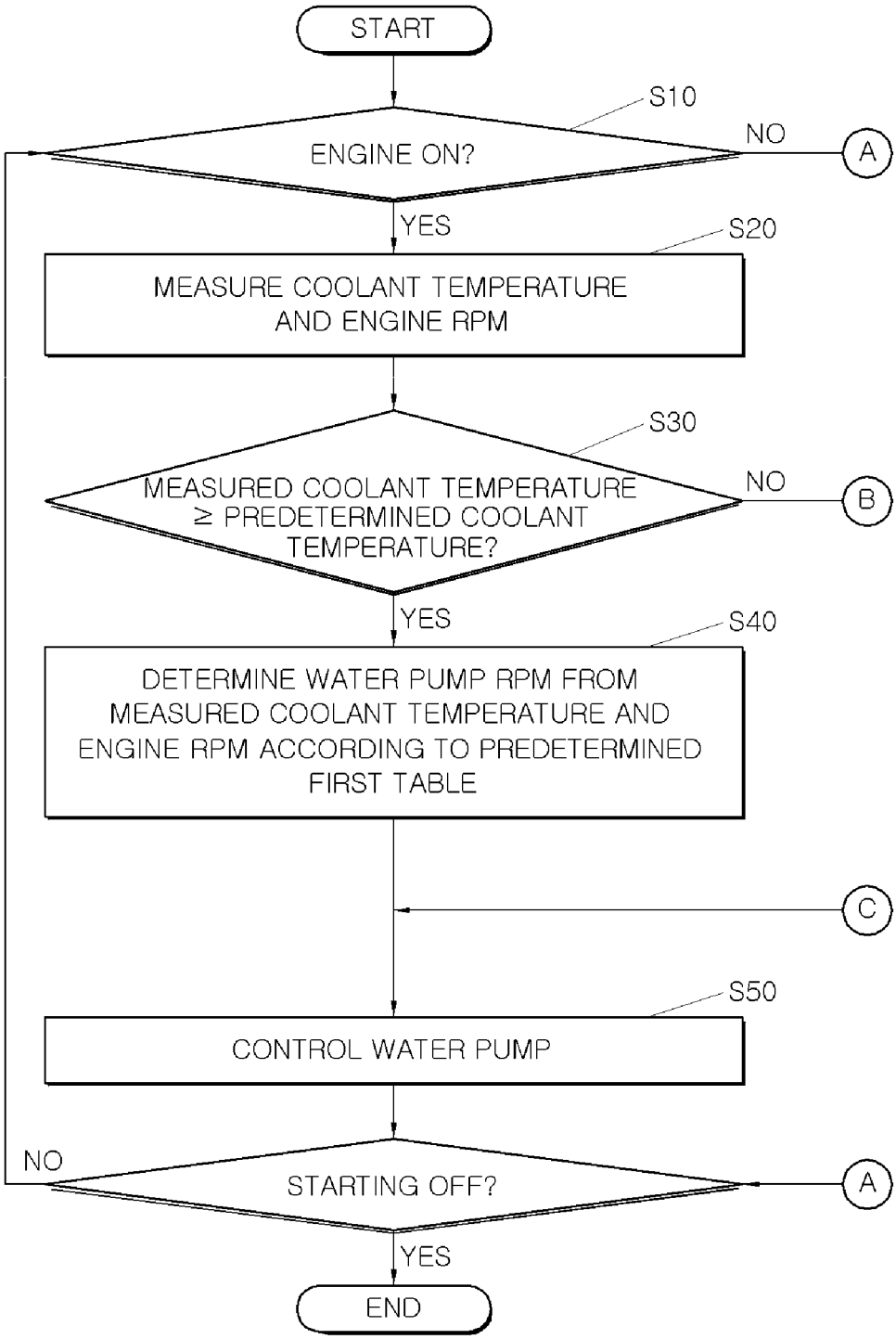
Figure 5B:
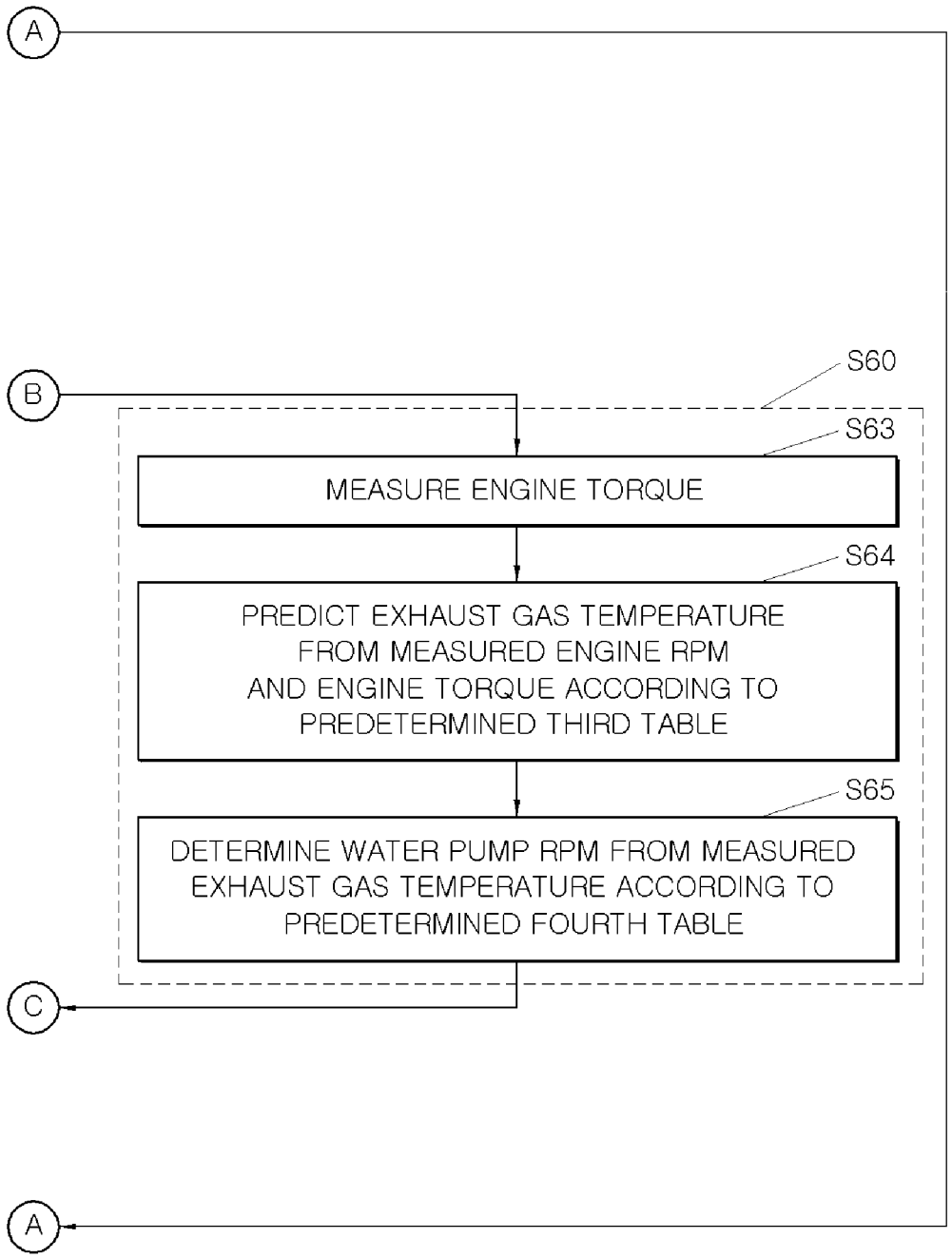

The terms and words used in the specification and claims should not be construed as their ordinary or dictionary sense. On the basis of the principle that the inventor can define the appropriate concept of a term in order to describe his/her own invention in the best way, it should be construed as meaning and concepts for complying with the technical idea of the present disclosure. Accordingly, the embodiments described in the specification and the construction shown in the drawings are nothing but one exemplary embodiment, and it does not cover all the technical ideas of the invention. Thus, it should be understood that various changes and modifications may be made at the time of filing the present application. In addition, detailed descriptions of functions and constructions well known in the art may be omitted to avoid unnecessarily obscuring the gist of the present disclosure. Exemplary embodiments will be described below in more detail with reference to the accompanying drawings.

Figure 6:
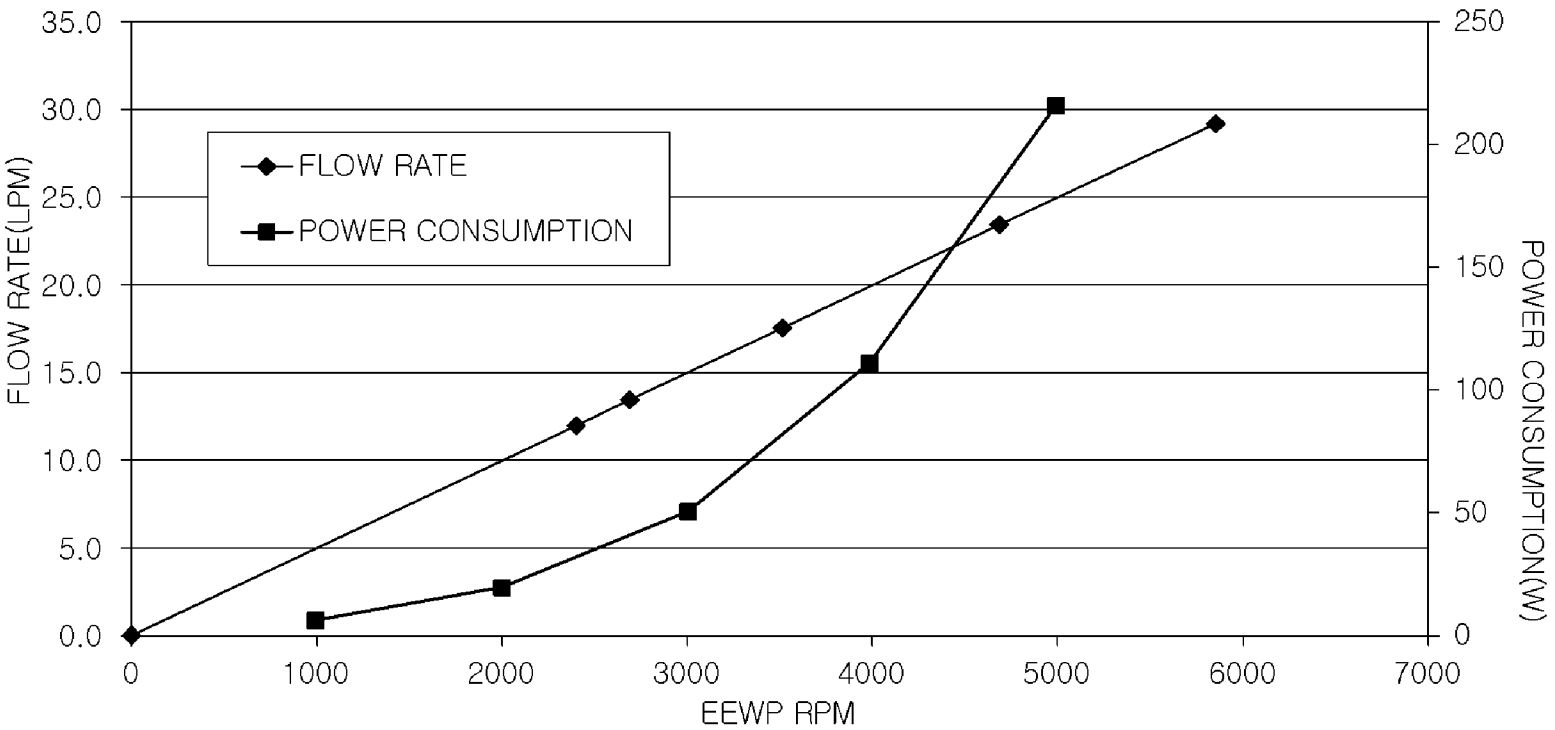
FIG. 6 is a graph illustrating a performance curve of a water pump for a vehicle according to an embodiment of the present inventive concept.

FIGS. 3 to 5B are flowcharts illustrating a method for controlling a water pump for a vehicle according to an embodiment of the present inventive concept. FIG. 6 is a graph illustrating a performance curve of a water pump. Referring to FIGS. 3 to 6, the method for controlling a water pump for a vehicle includes determining whether an engine is on (S10), measuring a coolant temperature of the engine and a revolutions per minute (RPM) of the engine when the engine is determined to be operated (S20), determining whether the measured coolant temperature is equal to or greater than a predetermined coolant temperature (S30), determining, when the measured coolant temperature is determined to be equal to or greater than the predetermined coolant temperature, an RPM of a water pump for adjusting a coolant flow rate from the measured coolant temperature and the measured RPM of the engine (S40), and controlling the water pump such that the water pump is operated according to the determined RPM of the water pump (S50).

When the engine is off, high-temperature exhaust gas is not discharged. Accordingly, since the coolant temperature is not increased in an exhaust heat recovery system, the RPM of the water pump is not separately controlled. The predetermined coolant temperature is a minimum coolant temperature for warm-up of the engine, and may be differently set according to a type of vehicle, a temperature outside the vehicle, etc. When the measured coolant temperature is determined to be equal to or greater than the predetermined coolant temperature, the engine may be fully warmed up even though the flow of the coolant is increased. Therefore, the RPM of the water pump is controlled such that efficiency of the exhaust heat recovery system is maximized.

In step S40, the RPM of the water pump is determined from the measured coolant temperature and the measured RPM of the engine according to a predetermined first table. That is, the flow rate of coolant supplied to the exhaust heat recovery system is controlled by determining the RPM of the water pump according to the measured coolant temperature and the measured RPM of the engine, so as not to disturb the warm-up of the engine while the efficiency of the exhaust heat recovery system is maximized. The predetermined first table is a table in which the measured coolant temperature, the measured RPM of the engine, and the optimal RPM of the water pump determined according to the same (i.e. the RPM of the water pump for securing the coolant flow rate such that the efficiency of the exhaust heat recovery system is maximized) are set.

The method for controlling the water pump further includes determining, when the measured coolant temperature is determined to be less than the predetermined coolant temperature, an RPM of the water pump for adjusting the coolant flow rate from an exhaust gas temperature (S60). Step S60 includes measuring the exhaust gas temperature (S61) and determining the RPM of the water pump from the measured exhaust gas temperature according to a predetermined second table (S62). The predetermined second table is a table in which the measured exhaust gas temperature and the optimal RPM of the water pump determined according to the same (i.e. the RPM of the water pump for securing the coolant flow rate such that the efficiency of the exhaust heat recovery system is maximized) are set. That is, when the exhaust gas temperature is high even though the coolant temperature is low, the efficiency of the exhaust heat recovery system is increased by increasing the coolant flow rate. In this case, the optimal coolant flow rate is determined by the RPM of the water pump determined according to the predetermined second table.

Each of the RPMs of the water pump in step S40, step S60, and step S50 is determined to be an RPM corresponding to a performance curve of the water pump illustrated in FIG. 6, with respect to the coolant flow rate determined by the first or second table. In addition, the water pump is controlled such that power consumption corresponding to the RPM of the water pump is supplied to the water pump, in order to operate the water pump by the determined RPM of the water pump.

In another embodiment, step S60 includes measuring a torque of the engine (S63), predicting the exhaust gas temperature from the measured RPM of the engine and the measured torque of the engine according to a predetermined third table (S64), and determining the RPM of the water pump from the predicted exhaust gas temperature according to a predetermined fourth table (S65).

The predetermined third table is a table in which the measured RPM of the engine, the measured torque of the engine, and the exhaust gas temperature predicted according to the same are set. The predetermined fourth table is a table in which the predicted exhaust gas temperature and the optimal RPM of the water pump determined according to the same (i.e. the RPM of the water pump for securing the coolant flow rate such that the efficiency of the exhaust heat recovery system is maximized) are set.

That is, unlike step S61 of measuring the exhaust gas temperature and step S62 of determining the RPM of the water pump from the measured exhaust gas temperature, the exhaust gas temperature is predicted from the verifiable RPM and torque of the engine in the conventional vehicle, without additionally mounting a separate device for measuring an exhaust gas temperature, and thus, the RPM of the water pump (i.e. the coolant flow rate) is determined in the alternative embodiment. Therefore, costs may be reduced by exclusion of the additional device.

Figure 7:
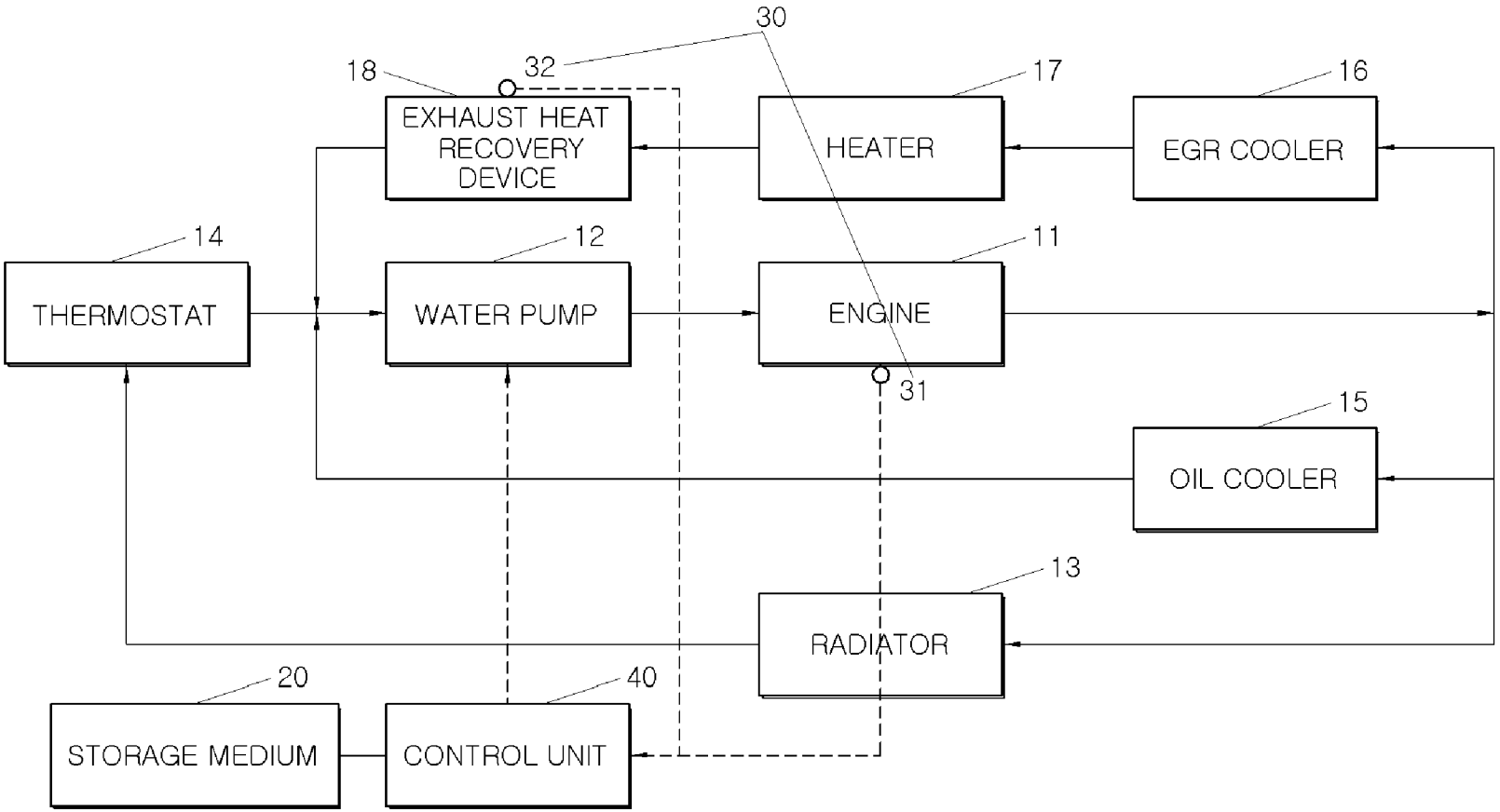
FIG. 7 is a block diagram illustrating an apparatus for controlling a water pump for a vehicle according to another embodiment of the present inventive concept.
Figure 8:
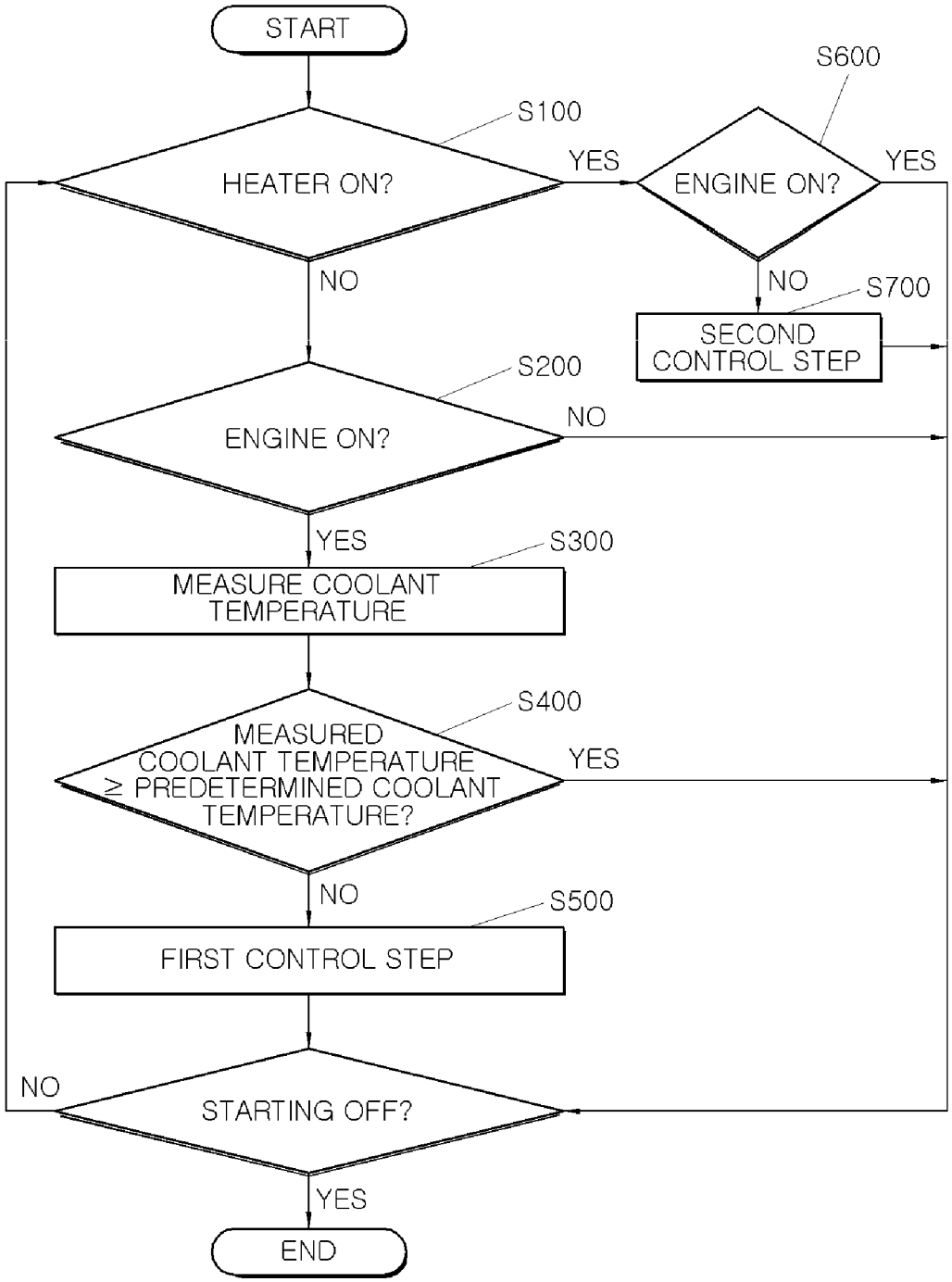
FIGS. 8 to 10B are flowcharts illustrating a method for controlling a water pump for a vehicle according to still another embodiment of the present inventive concept.
Figure 9A:
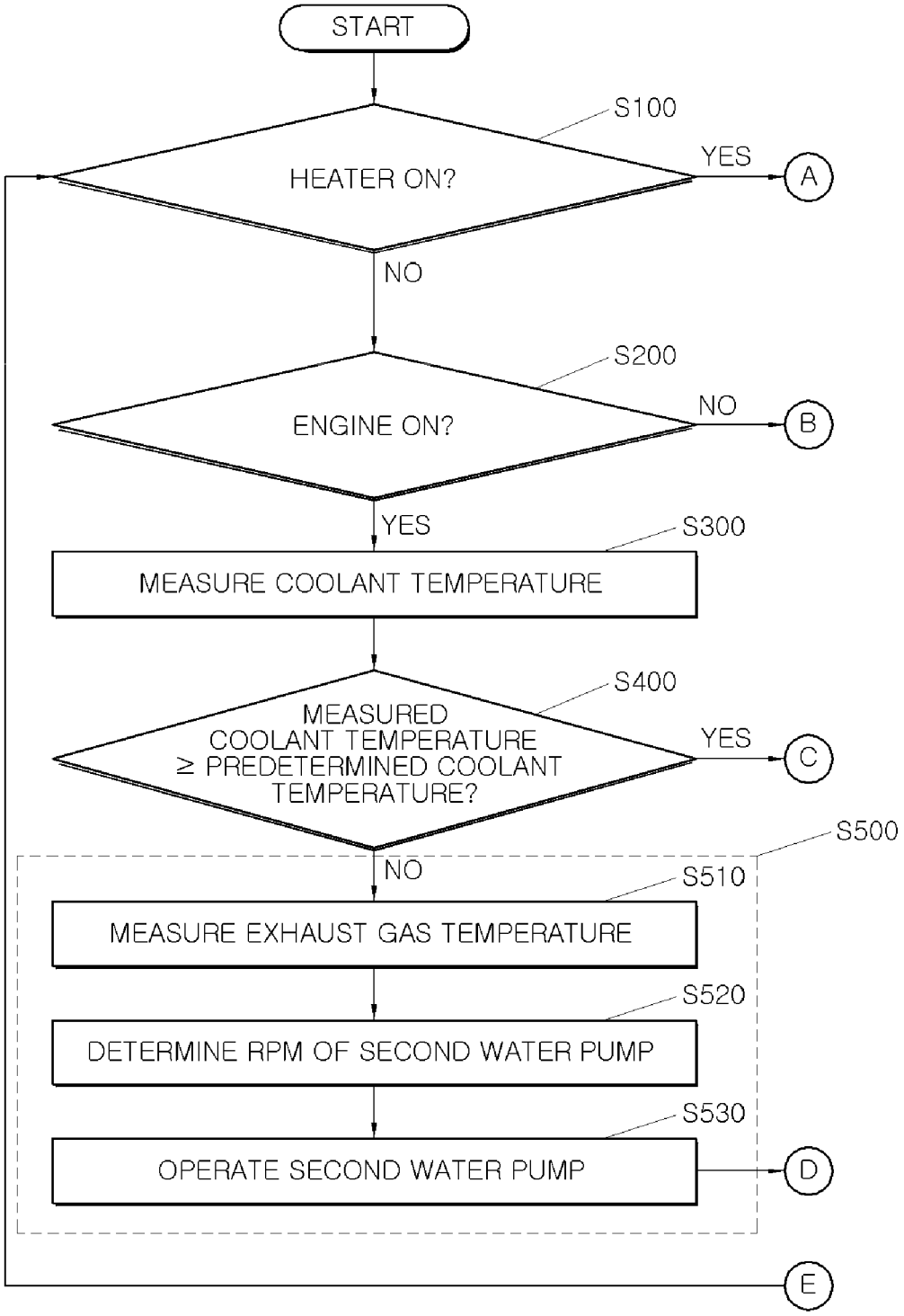
Figure 9B:
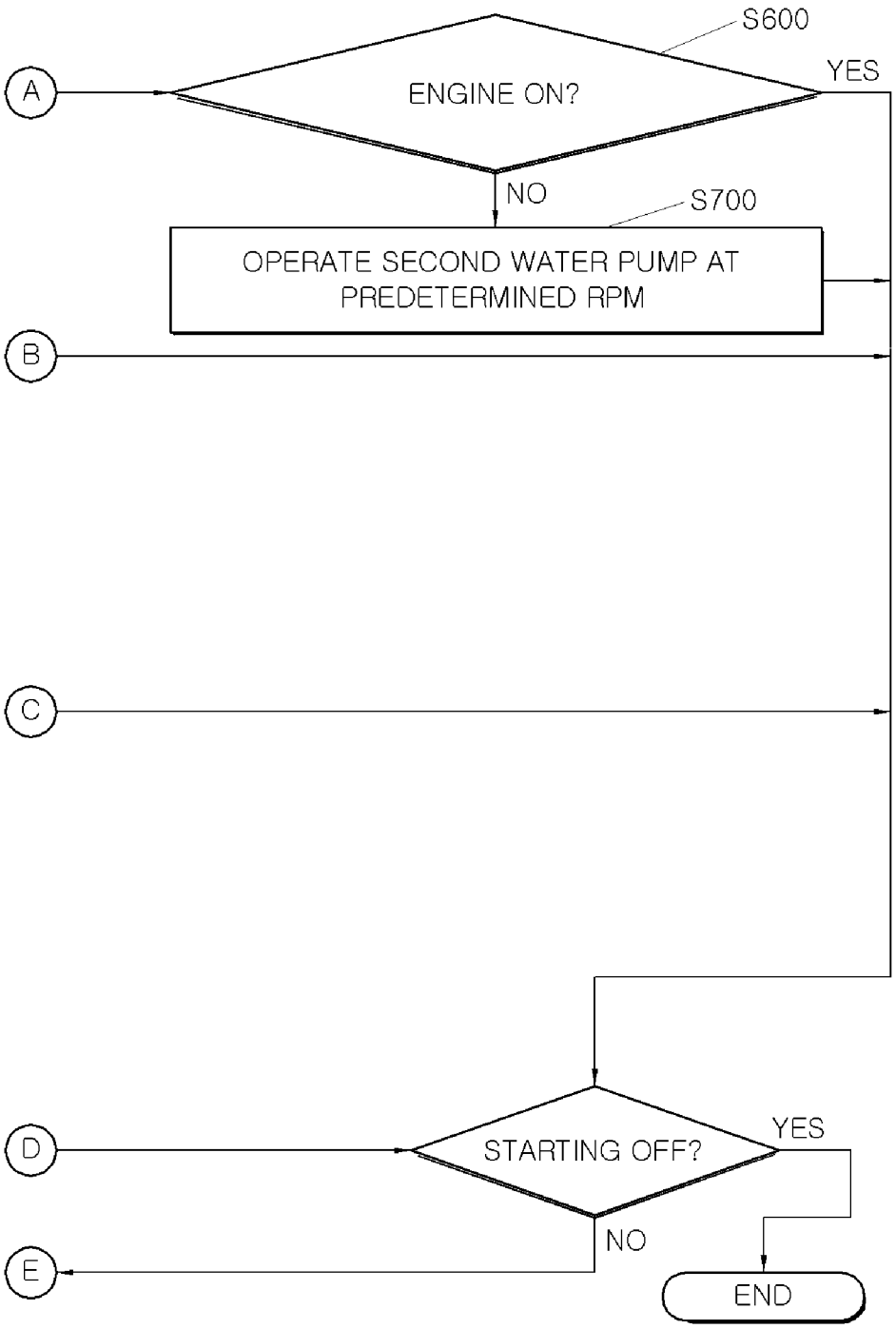
Figure 10A:
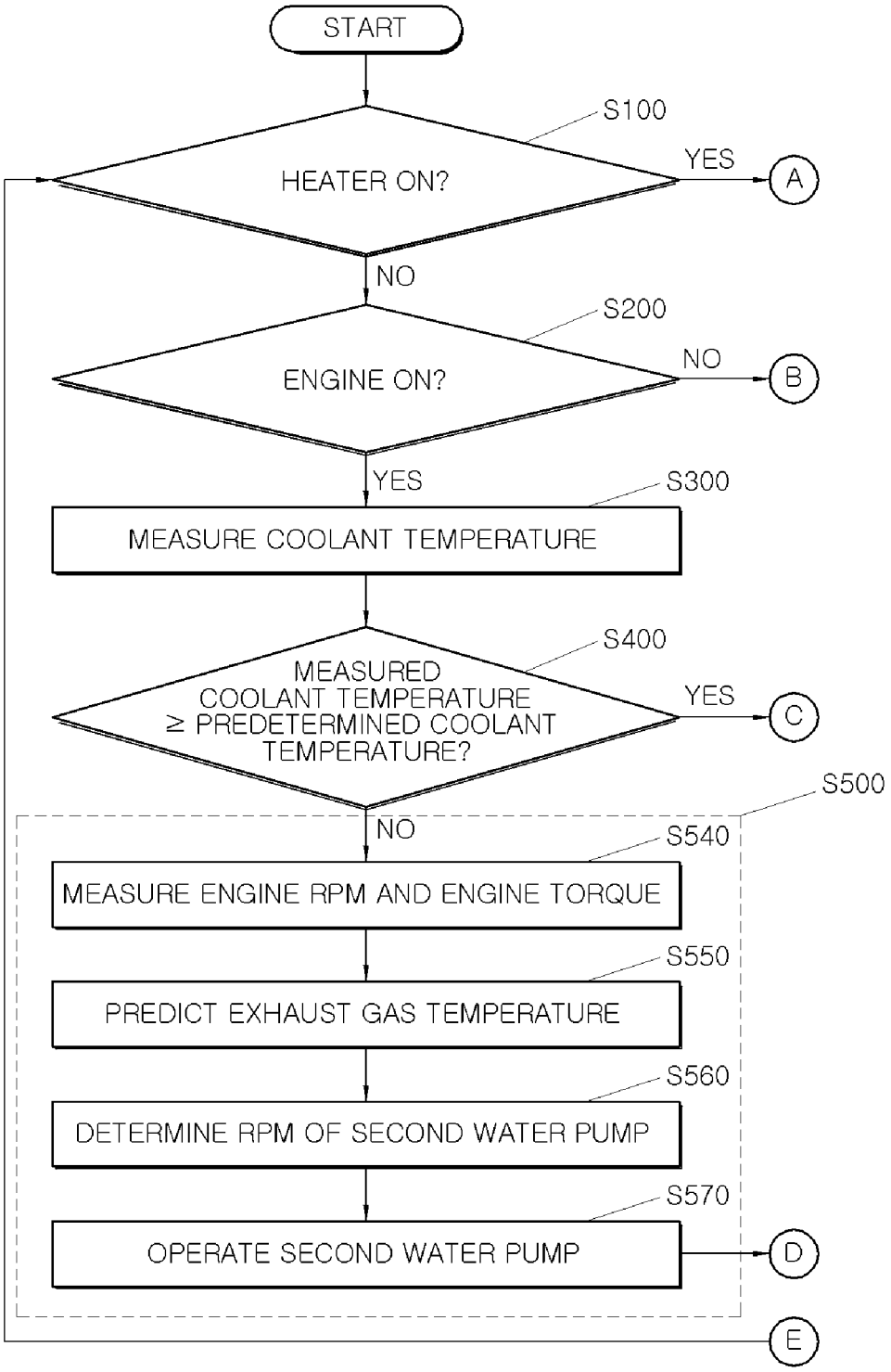
Figure 10B:
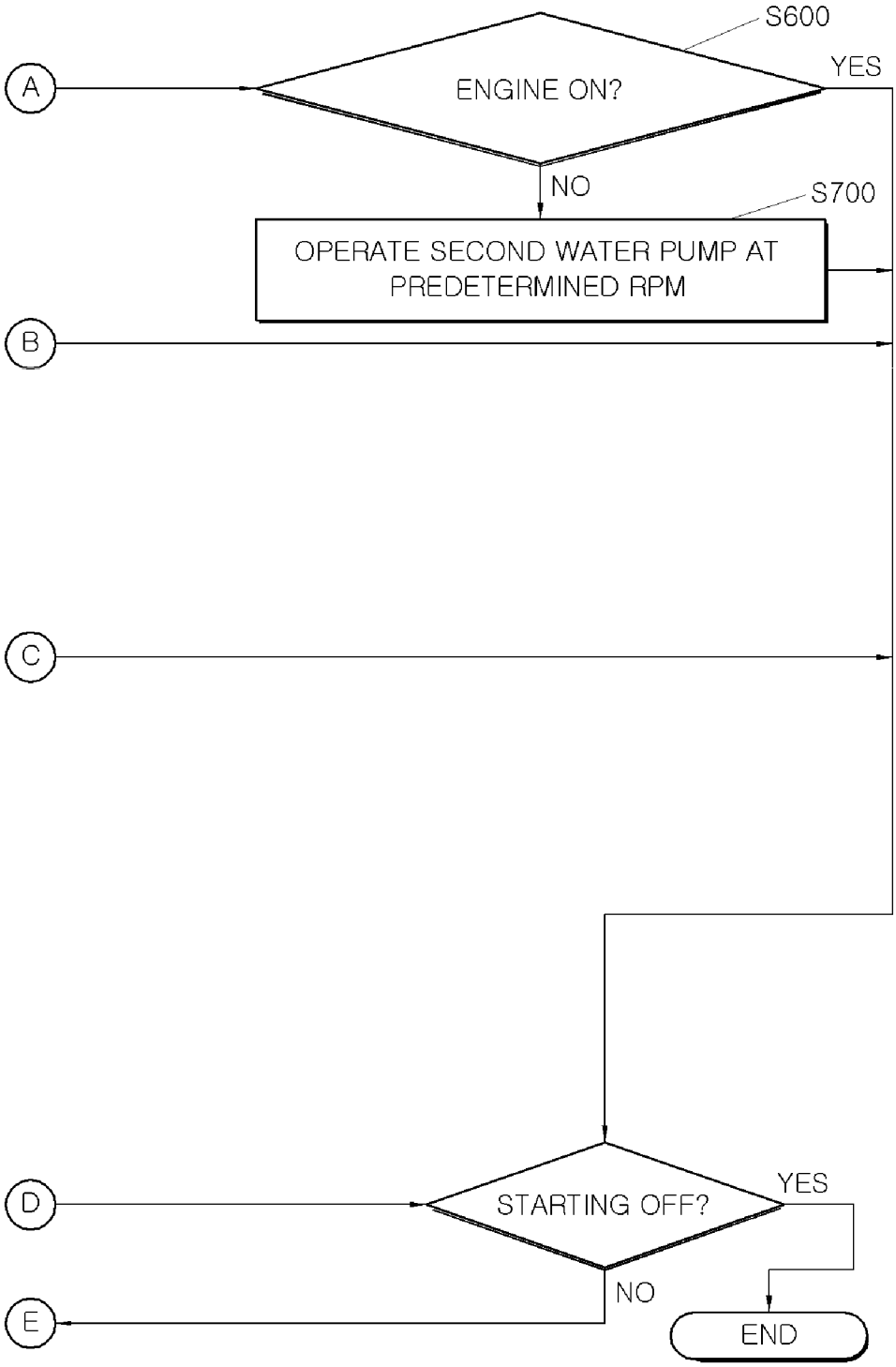

FIG. 7 is a block diagram illustrating an apparatus for controlling a water pump for a vehicle according to the present Disclosure. Referring to FIG. 7, the apparatus for controlling a water pump for a vehicle includes an engine 11, a water pump 12 for supplying coolant to the engine 11, a radiator 13 for cooling the coolant discharged from the engine 11, a thermostat 14 arranged between the water pump 12 and the radiator 13 to open and close a coolant passage, an oil cooler 15 for cooling oil using the coolant discharged from the engine 11, an exhaust gas recirculation (EGR) cooler 16 for cooling recirculated exhaust gas using the coolant discharged from the engine 11, a heater 17 for heating a vehicle interior using the coolant discharged from the EGR cooler 16, and an exhaust heat recovery system 18 for increasing a temperature of the coolant discharged from the heater 17 using the exhaust gas discharged from the engine 11. The apparatus includes a storage 20 for storing the method for controlling the water pump, a measurement unit 30 which includes a first measurement unit 31 for measuring an RPM of the engine 11, a torque of the engine 11, and a coolant temperature and a second measurement unit 32 for measuring an exhaust gas temperature, and a control unit 40 for determining an RPM of the water pump 12 according to the measured RPM of the engine 11, the measured torque of the engine 11, the measured coolant temperature, and the measured exhaust gas temperature so as to operate the water pump 12 according to the determined RPM of the water pump 12.

Figure 11:
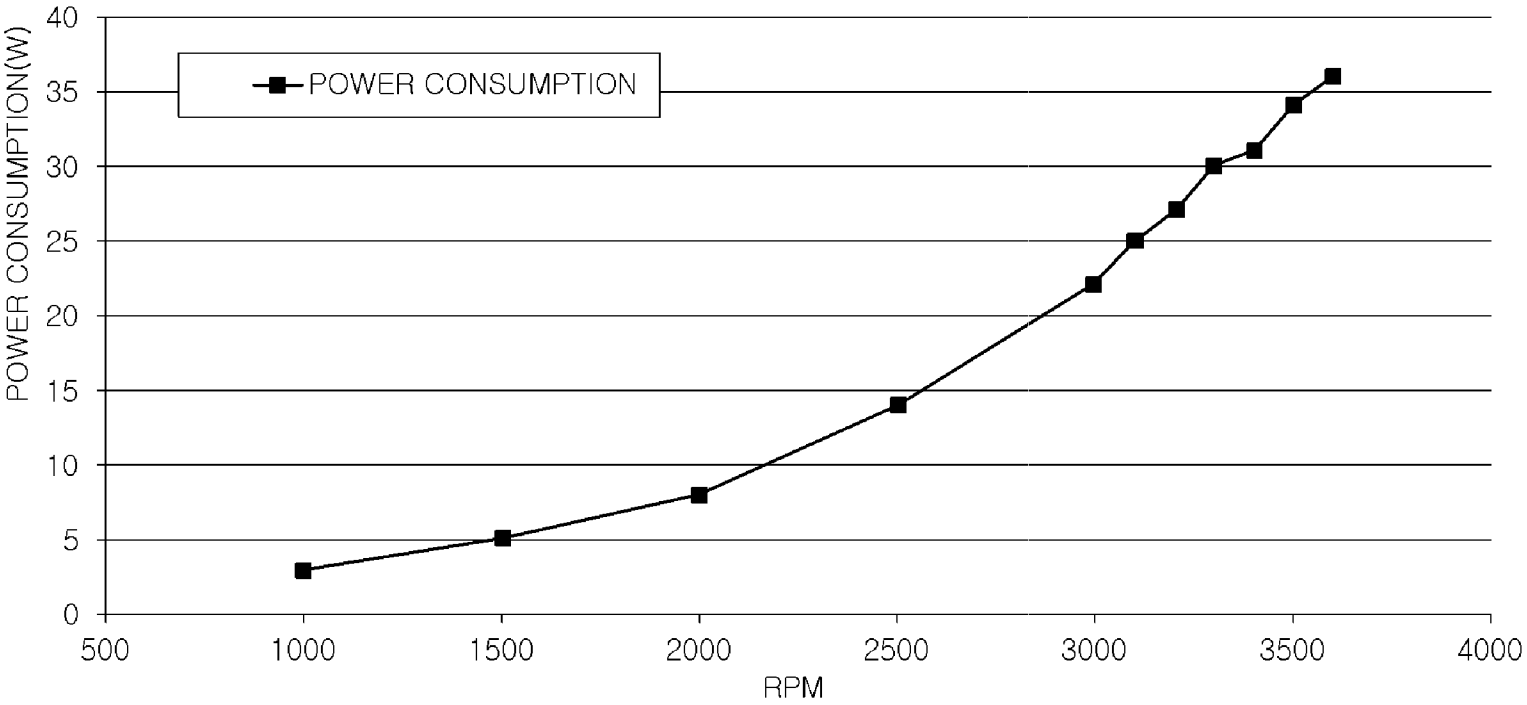
FIG. 11 is a graph illustrating a performance curve of a water pump for a vehicle according to an embodiment of the present inventive concept.

FIGS. 8 to 10B are flowcharts illustrating a method for controlling a water pump for a vehicle according to another embodiment. FIG. 11 is a graph illustrating a performance curve of a water pump. Referring to FIGS. 8 to 11, the method for controlling the water pump includes determining whether a heater is operated (S100), determining whether an engine is operated when the heater is determined to be not operated (S200), measuring a coolant temperature when the engine is determined to be operated in step S200 (S300), determining whether the measured coolant temperature is equal to or greater than a predetermined coolant temperature (S400), controlling, when the measured coolant temperature is determined to be less than the predetermined coolant temperature, an RPM of a second water pump, which is used for heating and adjusts a coolant flow rate, from an exhaust gas temperature (S500). The method for controlling the water pump further includes determining whether the engine is operated when the heater is determined to be operated (S600), controlling the second water pump to be operated at a predetermined RPM when the engine is determined to be not operated (S700).

Since heating is required due to the operation of the heater and heat for the heating is fully secured when the engine is driven, the second water pump is not separately controlled. The heating is not required when the heater is not operated, and thus, the second water pump is not separately controlled even though the engine is not driven. In addition, heat for the heating is fully secured even though the measured coolant temperature is determined to be equal to or greater than the predetermined coolant temperature, and thus, the second water pump is not separately controlled.

However, when the heating is not required when the heater is off and the measured coolant temperature is determined to be equal to or greater than the predetermined coolant temperature while the engine is on, the engine may be fully warmed up even though the flow of the coolant is increased. Accordingly, in order to maximize the efficiency of the exhaust heat recovery system, step S500 is carried out so that the RPM of the second water pump is controlled. In addition, when the heating is required due to the operation of the heater, there is a need to perform the heating according to a driver's intention even though the engine is not operated. Accordingly, step S700 is carried out so that the second water pump is controlled according to the predetermined RPM.

The predetermined coolant temperature is a minimum coolant temperature for warm-up of the engine, and may be differently set according to the type of vehicle, the temperature outside the vehicle, etc. In addition, the predetermined RPM may be set differently according to a type of vehicle, a temperature outside the vehicle, etc.

The first control step S500 includes measuring the exhaust gas temperature (S510), determining the RPM of the second water pump from the measured exhaust gas temperature according to a predetermined fifth table (S520), and operating the second water pump according to the determined RPM of the second water pump (S530). The predetermined fifth table is a table in which the measured exhaust gas temperature and the optimal RPM of the water pump determined according to the same (i.e. the RPM of the water pump for securing the coolant flow rate such that the efficiency of the exhaust heat recovery system is maximized) are set. That is, when the exhaust gas temperature is high even though the coolant temperature is low, the efficiency of the exhaust heat recovery system is increased by increasing the coolant flow rate. In this case, the optimal coolant flow rate is determined by the RPM of the water pump determined according to the predetermined second table.

In another embodiment, the first control step S500 may include measuring an RPM of the engine and a torque of the engine (S540), predicting the exhaust gas temperature from the measured RPM of the engine and the measured torque of the engine according to a predetermined sixth table (S550), determining the RPM of the second water pump from the predicted exhaust gas temperature according to a predetermined seventh table (S560), and operating the second water pump according to the determined RPM of the second water pump (S570).

The predetermined sixth table is a table in which the measured RPM of the engine, the measured torque of the engine, and the exhaust gas temperature predicted according to the same are set. The predetermined seventh table is a table in which the predicted exhaust gas temperature and the optimal RPM of the water pump determined according to the same (i.e. the RPM of the water pump for securing the coolant flow rate such that the efficiency of the exhaust heat recovery system is maximized) are set.

That is, unlike step S510 of measuring the exhaust gas temperature, step S520 of determining the RPM of the second water pump from the measured exhaust gas temperature according to a predetermined fifth table, and step S530 of operating the second water pump according to the determined RPM of the second water pump in the above embodiment, the exhaust gas temperature is predicted from the verifiable RPM and torque of the engine in the conventional vehicle without a need to additionally mount a separate device for measuring an exhaust gas temperature. Thus, the RPM of the water pump (i.e. the coolant flow rate) is determined in the alternative embodiment. Therefore, costs may be reduced by exclusion of the additional device.

Each of the RPMs of the water pump in steps S520 and S530 is determined to be an RPM corresponding to the performance curve of the water pump illustrated in FIG. 11 with respect to the coolant flow rate determined by the fifth or seventh table. In addition, the analysis result of a difference between flow rates when the second water pump is operated and when the second water pump is not operated is indicated by the following Table 2. Accordingly, it may be seen that the flow rate of the coolant introduced into the exhaust heat recovery system is increased by the operation of the second water pump, and thus, the efficiency of the exhaust heat recovery system is increased.

TABLE 2

| Engine: 2000 RPM<br>Second water pump: 4000 RPM | No operation of second water pump | Operation of second water pump |
|---|---|---|
| Flow rate in exhaust heat recovery system (analysis) | 12.7 LPM | 28.4 LPM |
| Flow rate in oil cooler | 8.6 LPM | 6.5 LPM |

Figure 12:
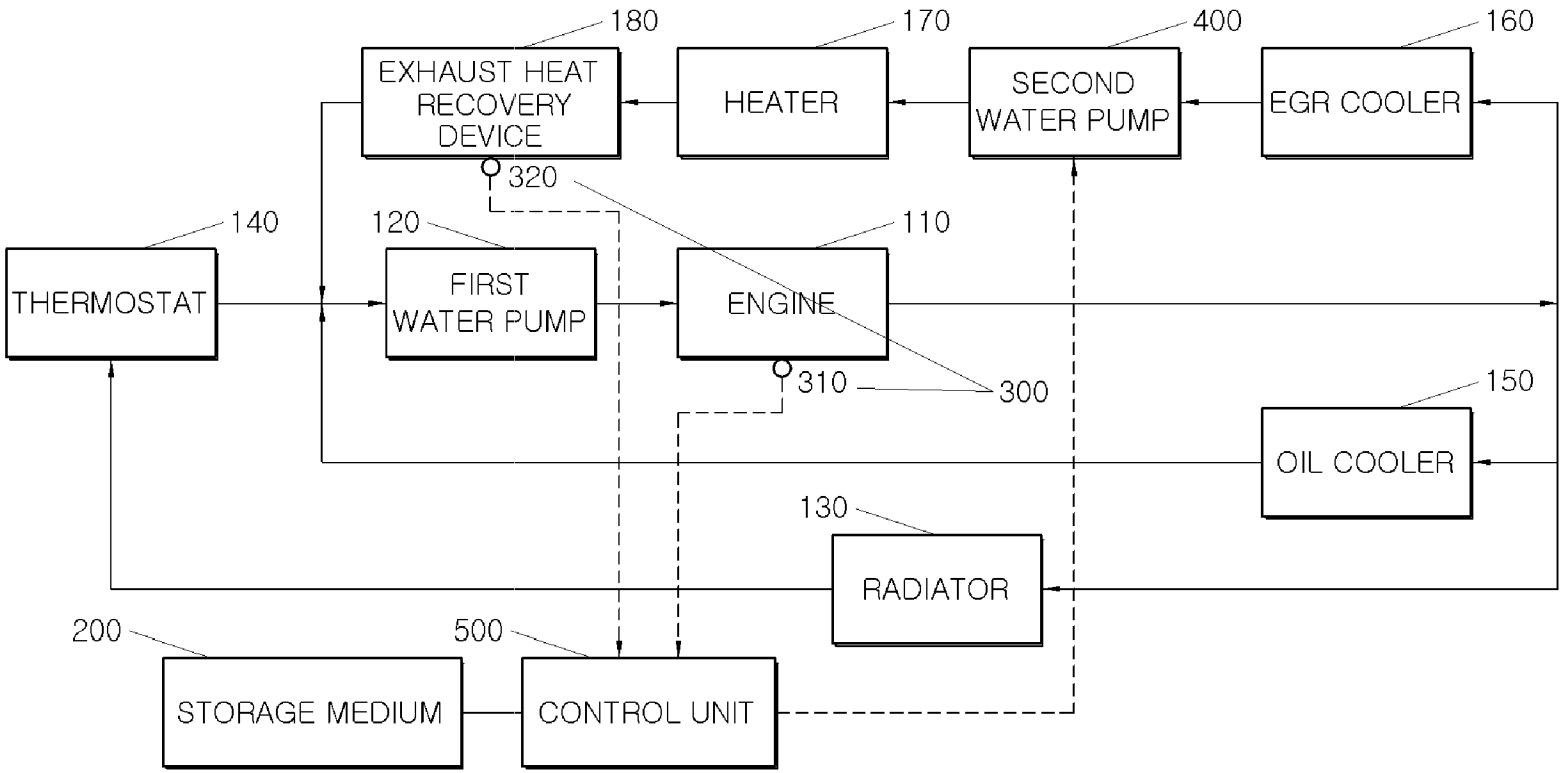
FIG. 12 is a block diagram illustrating an apparatus for controlling a water pump for a vehicle according to further embodiment of the present inventive concept.

FIG. 12 is a block diagram illustrating an apparatus for controlling a water pump for a vehicle according to another embodiment. Referring to FIG. 12, the apparatus for controlling a water pump for a vehicle according to the further embodiment of the present invention includes an engine 110, a first water pump 120 for supplying coolant to the engine 110, a radiator 130 for cooling the coolant discharged from the engine 110, a thermostat 140 arranged between the first water pump 120 and the radiator 130 to open and close a coolant passage, an oil cooler 150 for cooling oil using the coolant discharged from the engine 110, an EGR cooler 160 for cooling recirculated exhaust gas using the coolant discharged from the engine 110, a heater 170 for heating a vehicle interior using the coolant discharged from the EGR cooler 160, and an exhaust heat recovery system 180 for increasing a temperature of the coolant discharged from the heater 170 using the exhaust gas discharged from the engine 110. The apparatus includes a storage 200 for storing the method for controlling the water pump, a measurement unit 300 which includes a first measurement unit 310 for measuring an RPM of the engine, a torque of the engine, and a coolant temperature and a second measurement unit 320 for measuring an exhaust gas temperature, a second water pump 400 arranged between the EGR cooler 160 and the heater 170 to supply the coolant to the heater 170, and a control unit

500 for determining an RPM of the second water pump 400 according to the measured RPM of the engine, the measured torque of the engine, the measured coolant temperature, and the measured exhaust gas temperature so as to operate the second water pump 400 according to the determined RPM of the second water pump 400.

In accordance with the exemplary embodiments of the present inventive concept, it is possible to maximize efficiency of an exhaust heat recovery system by controlling a coolant flow rate.

In addition, since the efficiency of the exhaust heat recovery system is maximized without an additional configuration, costs and weight can be reduced compared to a case of enlarging a heat exchanger of the exhaust heat recovery system.

Further, it is possible to improve fuel efficiency and reduce a generation amount of noxious gas by inducing rapid warm-up of an engine when the engine is cold.

While the present disclosure has been described with respect to the specific embodiments, it will be apparent to those skilled in the art that various changes and modifications may be made without departing from the spirit and scope of the invention as defined in the following claims.

What is claimed is:

1. An apparatus for controlling a water pump for a vehicle, the apparatus comprising:

an engine;

the water pump for supplying coolant to the engine;

a radiator for cooling coolant discharged from the engine;

a thermostat arranged between the water pump and the radiator to open and close a coolant passage;

an oil cooler for cooling oil using coolant discharged from the engine;

an Exhaust Gas Recirculation (EGR) cooler for cooling recirculated exhaust gas using coolant discharged from the engine;

a heater for heating a vehicle interior using coolant discharged from the EGR cooler;

an exhaust heat recovery system for increasing a temperature of coolant discharged from the heater using the exhaust gas discharged from the engine;

a storage;

a first measurement unit configured to measure a Revolutions Per Minute (RPM) of the engine, a torque of the engine, and a coolant temperature;

a second measurement unit configured to measure an exhaust gas temperature; and a control unit configured to:

determine an RPM of the water pump according to the measured RPM of the engine, the measured torque of the engine, the measured coolant temperature, and the measured exhaust gas temperature; and control the water pump according to the determined RPM of the water pump.

* * * * *